US005665529A

United States Patent [19]

Ohkawa et al.

[11] Patent Number: 5,665,529

[45] Date of Patent: Sep. 9, 1997

[54] COLOR DIFFUSION TRANSFER PHOTOGRAPHIC MATERIAL

[75] Inventors: Atsuhiro Ohkawa; Hisashi Mikoshiba; Masaaki Tsukase; Yasuhiro Ishiwata; Hideaki Naruse, all of Kanagawa, Japan

[73] Assignee: Fuji Photo Film Co., Ltd., Kanagawa, Japan

[21] Appl. No.: 627,094

[22] Filed: Apr. 3, 1996

[30] Foreign Application Priority Data

Apr. 13, 1995 [JP] Japan ..... 7-111093

[51] Int. Cl.[6] ..... G03C 8/20; G03C 7/26

[52] U.S. Cl. ..... 430/562; 430/223

[58] Field of Search ..... 430/223, 562

[56] References Cited

U.S. PATENT DOCUMENTS

| | | | |
|---|---|---|---|
| 3,954,476 | 5/1976 | Krutak et al. | 430/223 |
| 4,250,246 | 2/1981 | Itoh et al. | 430/223 |
| 4,255,509 | 3/1981 | Ono et al. | 430/223 |
| 4,268,624 | 5/1981 | Fujita et al. | 430/223 |
| 4,524,122 | 6/1985 | Weber et al. | 430/223 |
| 4,560,645 | 12/1985 | Toriuchi et al. | 430/562 |

FOREIGN PATENT DOCUMENTS

| | | | |
|---|---|---|---|
| 59-114540 | 7/1984 | Japan | G03C 7/00 |

*Primary Examiner*—Richard L. Schilling

*Attorney, Agent, or Firm*—Sughrue, Mion, Zinn, Macpeak & Seas

[57] ABSTRACT

A color diffusion transfer photographic material is described, which comprises at least one compound represented by the following formula (I):

(I)

wherein $R^1$ and $R^2$ each independently represents a hydrogen atom, a substituted or unsubstituted alkyl group, or a substituted or unsubstituted aryl group, and $R^1$ and $R^2$ may be linked to form a ring directly or via an oxygen atom or a nitrogen atom; $R^3$ represents an $—NHSO_2R_{10}$ group, an $—SO_2NHCOR_{10}$ group, an $—SO_2NHSO_2R_{10}$ group, an $—NHCOR_{10}$ group or an —OH group; $R_{10}$ represents an alkyl group; $R^4$ and $R^5$ each represents a substituent and when there are a plurality of $R^4$ and $R^5$, they may be the same or different; CAR represents a group which releases a dye different from the compound represented by formula (I) in diffusibility by oxidation; x and y each represents 0 or an integer of 1, 2, 3 or 4; and z represents 0 or 1.

1 Claim, No Drawings

COLOR DIFFUSION TRANSFER PHOTOGRAPHIC MATERIAL

FIELD OF THE INVENTION

The present invention relates to a diffusion transfer color photographic material and, in particular, relates to a photographic material in which the fluctuation of the dye density after image formation is less and the sharpness is improved conspicuously.

BACKGROUND OF THE INVENTION

A color diffusion transfer photographic method using image-forming substances which give dyes different from image-forming substances themselves in diffusibility as a result of development under basic conditions has hitherto been well known, and as such image-forming substances (i.e., dye image-forming substances, dye-providing substances, dye-releasing compounds, image-forming compounds and dye image-forming compounds), the compounds disclosed in JP-A-59-114540 (the term "JP-A" as used herein means an "unexamined published Japanese patent application") and JP-A-60-79353 are known.

However, many of the ages released from these dye-releasing compounds remain in photographic units other than an image-receiving layer after image formation, and they are gradually diffused into an image-receiving layer and mordanted with the lapse of time to make image density higher (hereinafter referred to as post transfer) and also there arises a problem of photographic capability such that the sharpness is deteriorated.

This tendency is still conspicuous in the mode of usage of increasing neutralization timing. Therefore, the development of techniques for improving post transfer and sharpness has been strongly desired.

SUMMARY OF THE INVENTION

Accordingly, one object of the present invention is to provide a photographic material in which the post transfer is improved. Another object of the present invention is to provide a photographic material in which the sharpness is improved. Other object of the present invention is to provide a photographic material in which the sensitivity is improved. A further object of the present invention is to provide a photographic material in which the white background is improved. A still further object of the present invention is to provide a photographic material in which the fastness is improved.

The above objects of the present invention have been attained by the following (1) to (4).

(1) A color diffusion transfer photographic material which comprises at least one compound represented by the following formula (I):

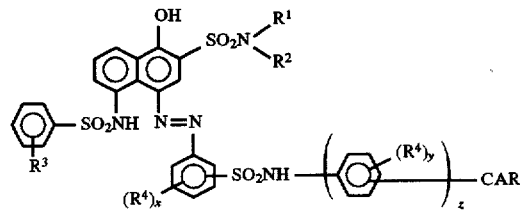

(I)

wherein $R^1$ and $R^2$ each independently represents a hydrogen atom, a substituted or unsubstituted alkyl group, or a substituted or unsubstituted aryl group, and $R^1$ and $R^2$ may be linked to form a ring directly or via an oxygen atom or a nitrogen atom; $R^3$ represents an $—NHSO_2R_{10}$ group, an $—SO_2NHCOR_{10}$ group, an $—SO_2NHSO_2R_{10}$ group, an $—NHCOR_{10}$ group or an —OH group; $R_{10}$ represents an alkyl group; $R^4$ and $R^5$ each represents a substituent and when there are a plurality of $R^4$ and $R^5$, they may be the same or different; CAR represents a group which releases a dye different from the compound represented by formula (I) in diffusibility by oxidation; x and y each represents 0 or an integer of 1, 2, 3 or 4; and z represents 0 or 1.

(2) The color diffusion transfer photographic material as described in (1) which contains an alkali treating composition.

(3) The color diffusion transfer photographic material as described in (2), which is a color diffusion transfer film unit comprising (1) a light-sensitive sheet comprising a transparent support having provided thereon an image-receiving layer, a white reflective layer, a shading layer and at least one silver halide emulsion layer combined with at least one dye image-forming compound, (2) a transparent cover sheet comprising a transparent support having provided thereon at least a neutralization layer and a neutralization timing layer, and (3) a shading alkali treating composition developed between the above-described light-sensitive sheet and the above-described transparent cover sheet.

(4) The color diffusion transfer photographic material as described in (2), which is a color diffusion transfer film unit comprising (1) an image-receiving sheet comprising a support having provided thereon a neutralization layer, a neutralization timing layer, an image-receiving layer and a peeling-off layer in this order, (2) a light-sensitive sheet comprising a support having a shading layer having provided thereon at least one silver halide emulsion layer combined with at least one dye image-forming compound, and (3) the alkali treating composition developed between the above-described image-receiving sheet and the above-described light-sensitive sheet.

DETAILED DESCRIPTION OF THE INVENTION

The present invention is described in detail below.

In compounds represented by formula (I), $R^1$ and $R^2$ each independently represents a hydrogen atom, a substituted or unsubstituted alkyl group, or a substituted or unsubstituted aryl group. Examples of the alkyl group include methyl, isopropyl, isobutyl, tert-butyl, etc., and the carbon atom number of these alkyl groups is preferably from 1 to 6, and particularly preferably 2 or 3. Examples of the aryl group include a phenyl group, a 1-napthyl group, a 2-naphthyl group, etc., and preferably a phenyl group. These alkyl and aryl groups may further have substituents, for example, an alkoxyl group, a halogen atom, an amino group, an aryl group, an alkyl group, a sulfamoyl group, a carbamoyl group, a cyano group, an alkoxycarbonyl group, etc., can be cited as such substituents. $R^1$ and $R^2$ may be linked to form a ring directly or via an oxygen atom or a nitrogen atom, and the ring is preferably a 5- or 6-membered ring.

$R^3$ represents an $—NHSO_2R_{10}$ group, an $—SO_2NHCOR_{10}$ group, an $—SO_2NHSO_2R_{10}$ group, an $—NHCOR_{10}$ group or an —OH group. $R_{10}$ represents an alkyl group, specifically, a methyl group, an ethyl group, an isopropyl group, a tert-butyl group, etc., and preferred carbon atom number is from 1 to 4, particularly preferably 1. $R_{10}$ may further have a substituent such as a fluorine atom, an alkoxyl group, etc. $R^3$ preferably represents an $—NHSO_2R_{10}$ group.

$R^4$ and $R^5$ each represents a substitutable group and when there are a plurality of $R^4$ and $R^5$, they may be the same or different. Specific examples of the substituents include a halogen atom (e.g., fluorine, chlorine), an amino group (e.g., dimethylamino, 1-pyrrolidinyl, 1-morpholino), a cyano group, a nitro group, an alkyl group (e.g., methyl, trifluoromethyl, isopropyl), an alkoxyl group (e.g., methoxy, isopropyloxy, 2-methoxyethoxy), an alkylsulfonyl group (e.g., methanesulfonyl, trifluoromethanesulfonyl, isopropylsulfonyl), a sulfamoyl group (e.g., sulfamoyl, isopropylsulfamoyl, dimethylsulfamoyl), a carbamoyl group (e.g., carbamoyl, dimethylcarbamoyl), an alkoxycarbonyl group (e.g., methoxycarbonyl, isopropyloxycarbonyl), etc.

CAR represents a group capable of releasing a group including a residual group connected to CAR in formula (I) by the breakage of the bond in a CAR group by oxidation. Examples of CAR are disclosed, for example, in U.S. Pat. Nos. 4,135,929, 4,053,312, 4,336,322, JP-A-48-33826, JP-A-51-104343, JP-A-53-46730, JP-A-54-130122, JP-A-51-113624, JP-A-56-12642, JP-A-56-161131, JP-A-57-4043, JP-A-57-650, JP-A-57-20735, JP-A-54-54021 and JP-A-56-71072. Specific examples thereof are shown below but the present invention is not limited thereto.

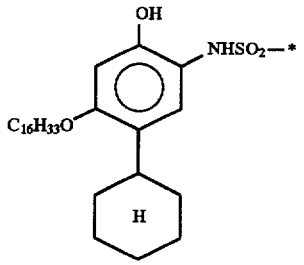

-continued

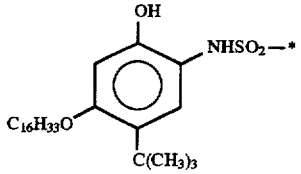

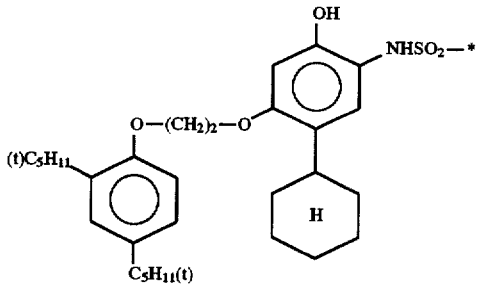

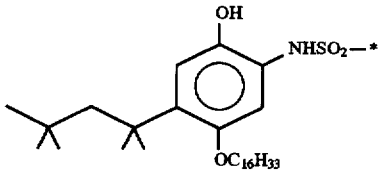

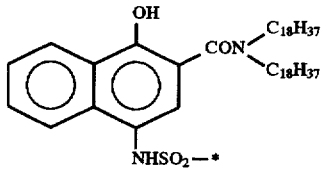

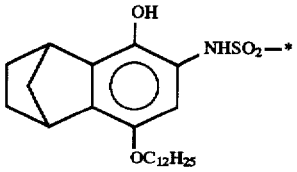

x and y each represents 0 or an integer of 1, 2, 3 or 4, preferably 0, 1 or 2, and particularly preferably 0 or 1.

z represents 0 or 1 and preferably 0.

The compounds represented by formula (I) according to the present invention are shown below, but it should not be construed as being limited thereto.

(1)
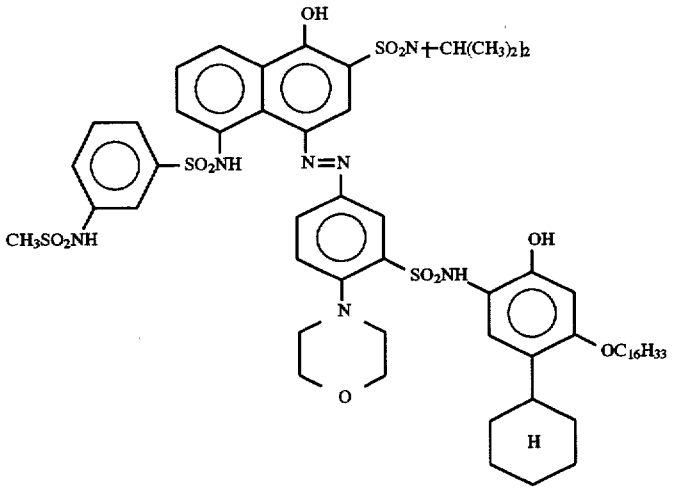
(2)
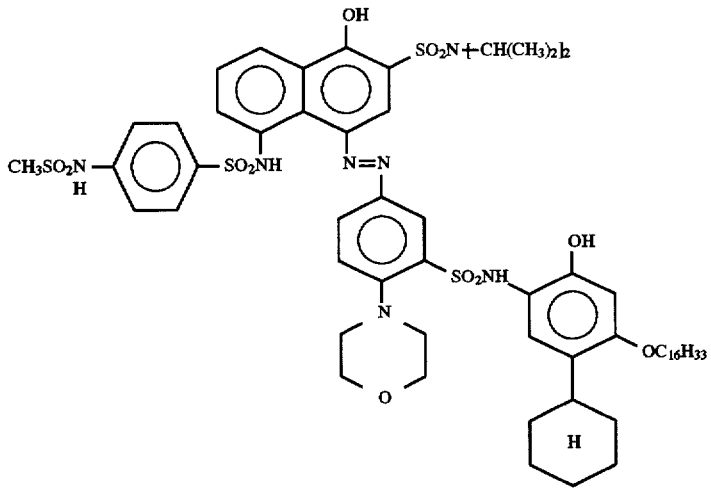
(3)
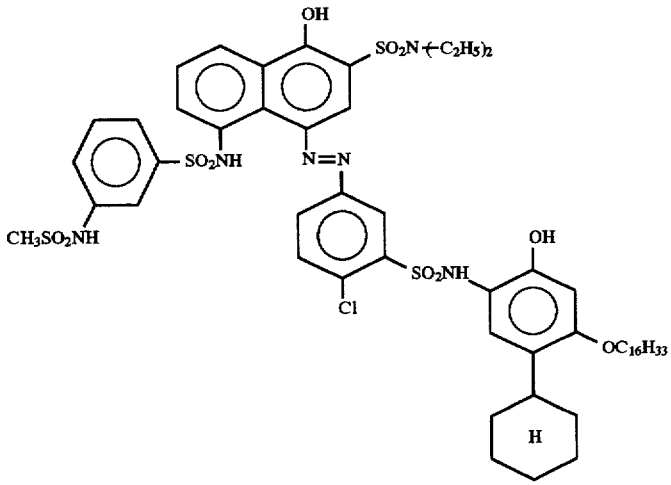

-continued
(4)
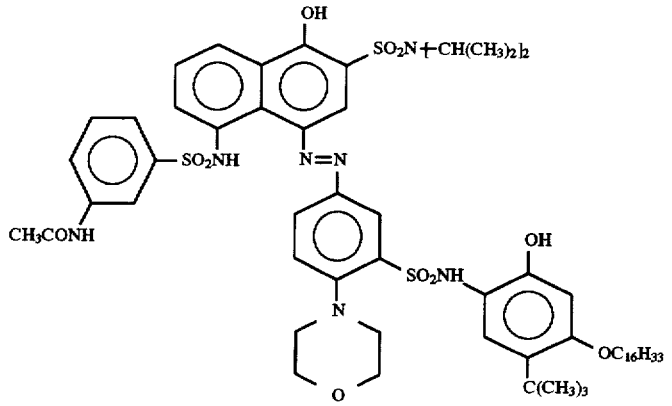
(5)
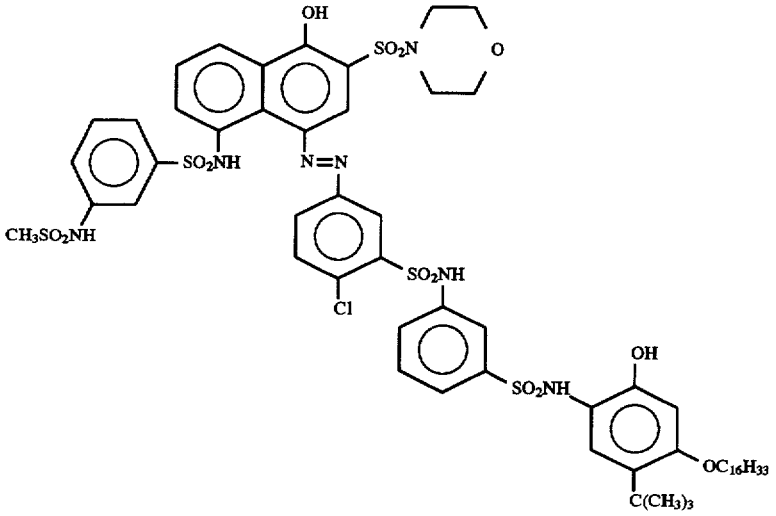
(6)
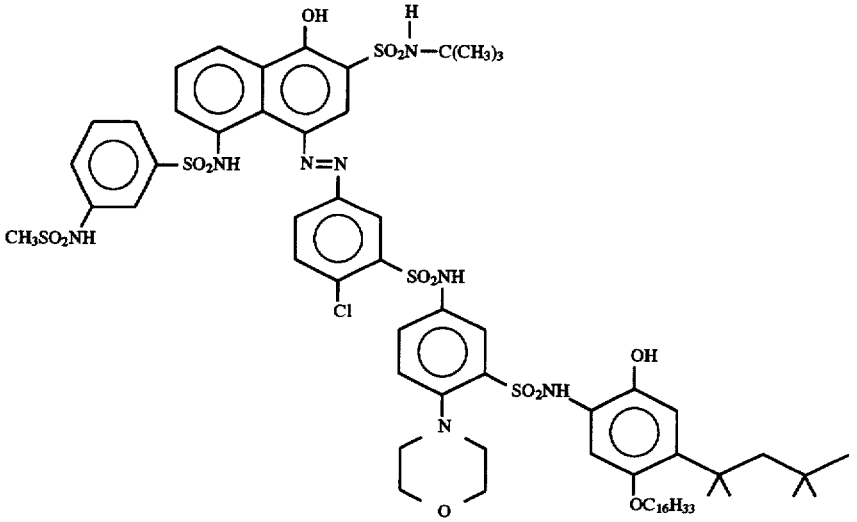

-continued
(7)
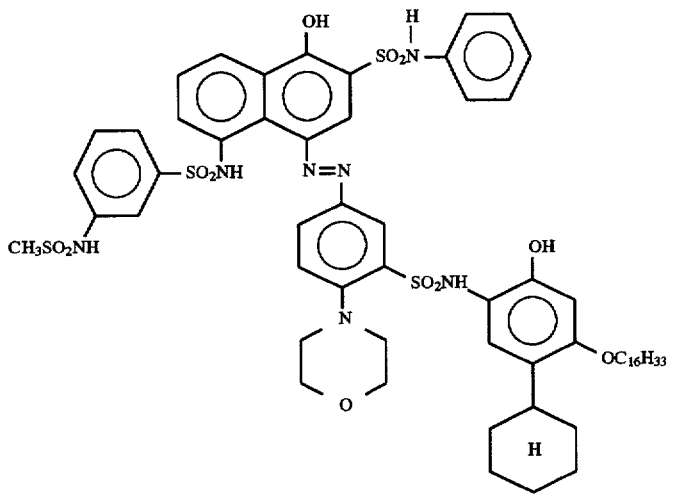
(8)
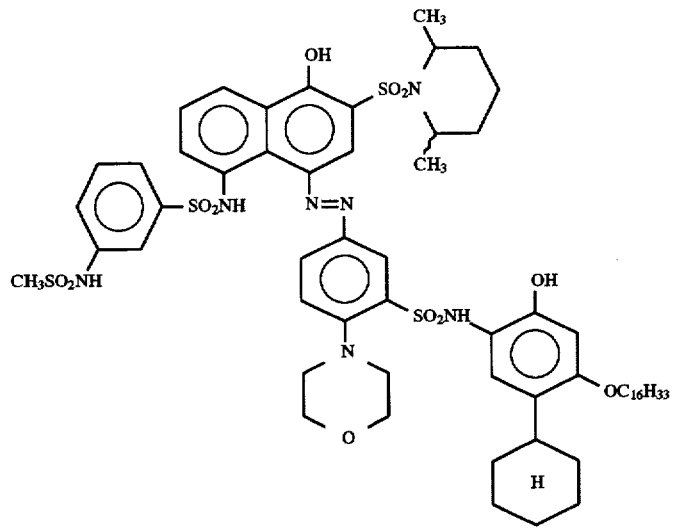
(9)
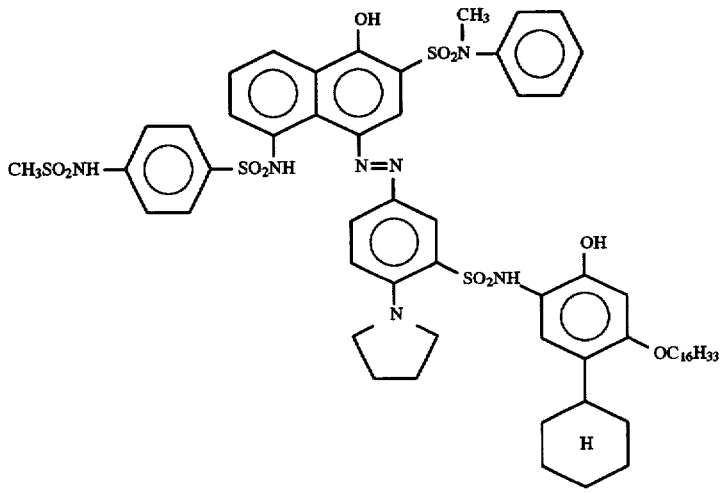

-continued
(10)
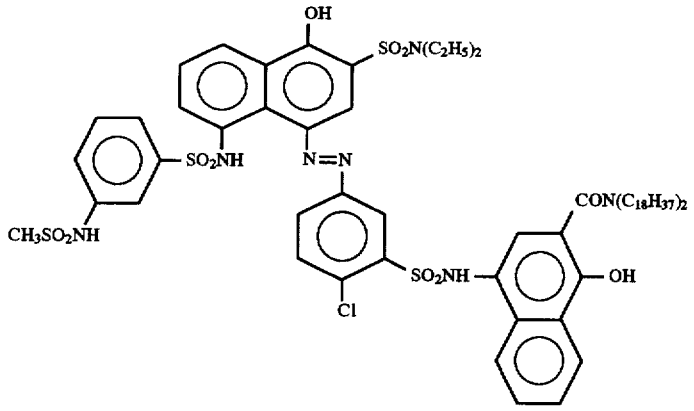
(11)
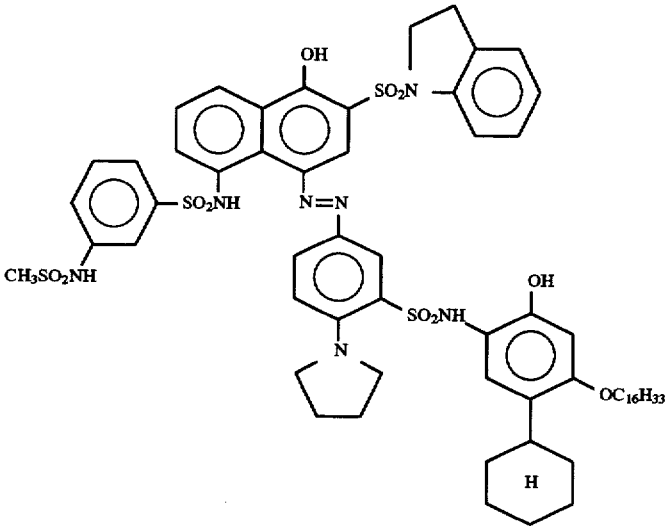
(12)
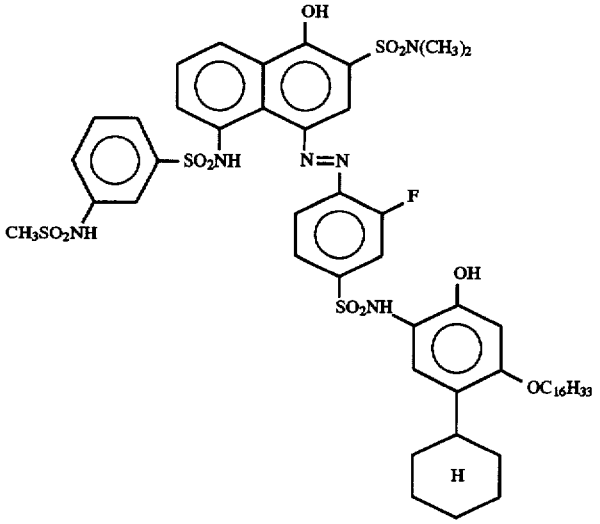

-continued (13)

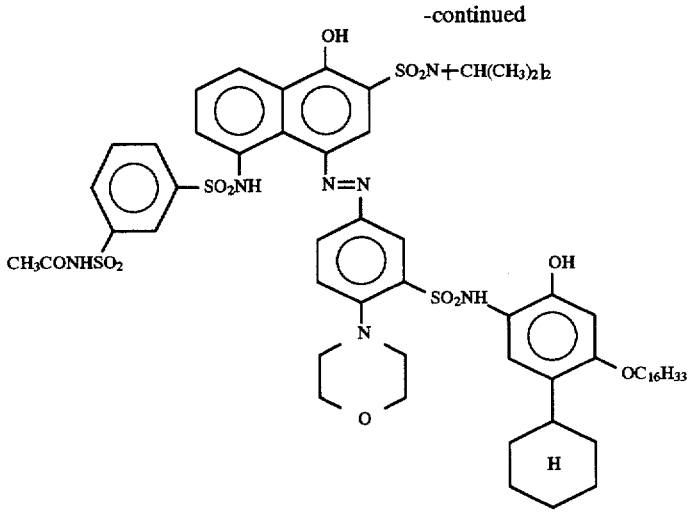

The compound of the present invention can be synthesized according to, for example, the method disclosed in JP-A-59-114540. Specific example is shown below taking Compound (1) as an example.

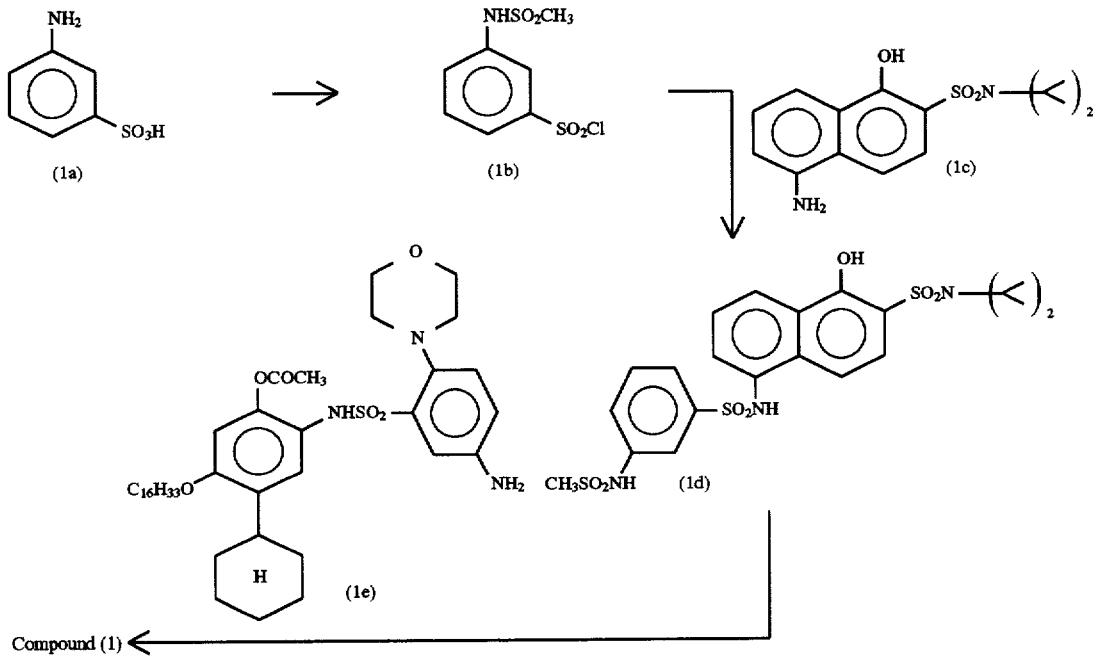

A mixture comprising 1a (80 g), pyridine (112 ml) and acetonitrile (400 ml) was neared to 50° C. Methanesulfonyl chloride (50 ml) was dropwise added thereto. After 1.5 hours, the mixture was cooled to 30° C., phosphorus oxychloride (51 ml) was added thereto and the mixture reacted for 2 hours. After the reaction solution was cooled with water, the solution was poured into 2 liters of ice water. The crystals precipitated were filtrated, washed with water and dried to obtain 115.4 g of 1b (92.7%).

A mixture comprising 1c (138 g), pyridine (69.1 ml) and acetonitrile (690 ml) was cooled to 5° C. 1b (137 g) was added thereto. After 2 hours, the reaction solution was poured into water (3.45 liters) containing concentrated hydrochloric acid (36.7 ml). The crystals obtained were filtrated and washed with water, then washed with heating in isopropyl alcohol (710 ml) to obtain 216 g of 1d (90.8%).

Concentrated hydrochloric acid (11 ml) was added to a mixture comprising 1e (20 g), acetic acid (21 ml) and 1-methoxy-2-propanol (120 ml) and the mixture was cooled to 0° C. A solution of water (5 ml) containing sodium nitrite (2.04 g) dissolved therein was dropwise added to the above mixture and diazonium salt was synthesized. Next, a solution comprising 1d (14.8 g), sodium acetate (33.1 g) and methanol (225 ml) was cooled to 0° C., then the above reaction solution of diazonium salt was dropwise added thereto. After the mixed reaction solution further reacted for 1 hour, the reaction solution was poured into water (1.1 liters), and the crystals precipitated were filtrated, washed with water and dried. The crystals obtained (35.2 g) were refluxed in a mixed solution of methanol (250 ml), acetonitrile (106 ml) and concentrated hydrochloric acid (13.8 ml) for 2 hours, and then cooled to room temperature to precipitate crystals. The crystals precipitated were filtrated and washed in methanol to obtain 23.2 g of the exemplified CompoUnd (1) (89.2%).

Color diffusion transfer processes for use in the present invention are described below.

A typical form of film units for use in color diffusion transfer processes is a form in which an image-receiving element and a light-sensitive element are laminated on one transparent support, and the light-sensitive element is not necessary to be peeled off from the image-receiving element after completion of a transferred image. More specifically, the image-receiving element comprises at least one mordant layer, and a preferred mode of the light-sensitive element is constituted by combining a combination of a blue-sensitive emulsion layer, a green-sensitive emulsion layer and a red-sensitive layer, of a green-sensitive emulsion layer, a red-sensitive emulsion layer and an infrared-sensitive emulsion layer, or of a blue-sensitive emulsion layer, a red-sensitive emulsion layer and an infrared-sensitive emulsion layer with a combination of a yellow dye-providing substance, a magenta dye-providing substance and a cyan dye-providing substance, in such a manner that the three emulsion layers comprise the three dye-providing substances, respectively ("an infrared-sensitive emulsion layer" used herein means an emulsion layer sensitive to light of a wavelength of 700 nm or more, in particular, 740 nm or more). A white reflective layer containing a solid pigment such as titanium oxide is provided between the mordant layer and the light-sensitive layer or between the mordant layer and the layer containing the dye-providing substance so as to be able to view the transferred image through the transparent support.

A shading layer may further be provided between the white reflective layer and the light-sensitive layer to make it possible to complete development processing in daylight. Also, a peeling-off layer may be provided in an appropriate position so as to be able to peel off all or a part of the light-sensitive element from the image-receiving element, if desired (such modes are disclosed, for example, in JP-A-56-67840 and Canadian Patent 674,082).

As another embodiment of a peeling-off mode of a lamination type, JP-A-63-226649 discloses a color diffusion transfer photographic film unit comprising a white support having provided thereon a light-sensitive element comprising at least (a) a layer having a neutralization function, (b) a dye image-receiving layer, (c) a peeling-off layer and (d) at least one silver halide emulsion layer combined with a dye image-forming substance in this order, in alkali treating composition containing a shading agent, and a transparent cover sheet, which film unit further comprises a layer having a shading function on the side opposite to the side on which the treating composition of the emulsion layer is developed.

Further, in another form in which peeling-off is unnecessary, the above-described light-sensitive element is coated on a transparent support, a white reflective layer is provided thereon, and an image-receiving layer is further laminated thereon. An embodiment in which an image-receiving element, a white reflective layer, a peeling-off layer and a light-sensitive element are laminated on the same support and the light-sensitive element is intentionally peeled off from the image-receiving element disclosed in U.S. Pat. No. 3,730,718.

On the other hand, typical forms in which a light-sensitive element and an image-receiving element are separately coated on two supports, respectively, may be divided broadly into two types. One is a peeling-off type and the other is a peeling-off-unnecessary type. These types are illustrated in detail below. In a preferred mode of the peeling-off type film unit, at least one image-receiving layer is provided on a support, and a light-sensitive element is provided on a support having a shading layer. A coated surface of the light-sensitive layer and a coated surface of a mordant layer do not face each other before termination of exposure, but after termination of exposure (for example, during development processing) the coated surface of the light-sensitive layer is turned over to be superposed on the coated surface of the image-receiving layer. After a transferred image is completed on the mordant layer, the light-sensitive element is rapidly peeled off from the image-receiving element.

Further, in a preferred mode of the peeling-off-unnecessary type film unit, at least one mordant layer is provided on a transparent support, and a light-sensitive element is provided on a transparent support or a support having a shading layer, and the light-sensitive layer is superposed on the mordant layer with coated surfaces facing each other.

A pressure-rupturable container containing an alkali treating solution (a treating element) may further be combined with the above-described forms. Above all, in the peeling-off-unnecessary type film unit in which the image-receiving element and the light-sensitive element are laminated on one support, this treating element is preferably arranged between the light-sensitive element and a cover sheet superposed thereon. In the form in which the light-sensitive element and the image-receiving element are separately coated on two supports, respectively, the treating element is preferably arranged between the light-sensitive element and the image-receiving element at development processing at latest. The treating element preferably contains a shading agent (such as carbon black and a dye which varies in color according to pH) and/or a white pigment (such as titanium oxide) according to the form of film units. Further, in the film unit of the color diffusion transfer system, a neutralization timing mechanism comprising a neutralization layer and a neutralization timing layer in combination is preferably incorporated into a cover sheet, an image-receiving element or a light-sensitive element.

Each constitutional element included in the present invention will be explained below.

I. Light-Sensitive sheet

A) Support

Any support generally used in a photographic material can be used as the support of the light-sensitive sheet in the present invention as long as it is a smooth and transparent support such as cellulose acetate, polystyrene, polyethylene terephthalate or polycarbonate, and preferably provided with an undercoat layer. The support preferably contains a trace amount of a dye or a pigment such as titanium oxide to usually prevent light piping.

The thickness of the support is from 50 to 350 μm, preferably from 70 to 210 μm, and more preferably from 80 to 150 μm.

A curl-balancing layer or the oxygen-shielding layer disclosed in JP-A-56-78833 can be provided on the back side of the support, if desired.

B) Image-Receiving Layer

The dye image-receiving layer for use in the present invention contains a mordant in a hydrophilic colloid. The layer may be a single layer or may be a multilayer structure multilayer-coated with mordants of different mordant abilities. This is disclosed in JP-A-61-252551. Polymer mordants are preferably used as a mordant.

Examples of the polymer mordants include polymers containing a secondary or tertiary amino group, polymers containing a nitrogen-containing heterocyclic moiety or polymers containing a quaternary cation, and preferably having a molecular weight of 5,000 or more, and particularly preferably 10,000 or more.

The coating weight of the mordant is generally from 0.5 to 10 g/m$^2$ preferably from 1.0 to 5.0 g/m$^2$, and particularly preferably from 2 to 4 g/m$^2$.

Examples of the hydrophilic colloids used in the image-receiving layer include gelatin, polyvinyl alcohol, polyacrylamide and polyvilnylpyrrolidone, but gelatin is preferably used.

The discoloration inhibitors disclosed in JP-B-62-30620 (the term "JP-B" as used herein means an "examined Japanese patent publication"), JP-B-62-30621 and JP-A-62-215272 can be incorporated into the image-receiving layer.

C) White Reflective Layer

The white reflective layer forming the white background of a color image usually comprises a white pigment and a hydrophilic binder.

Examples of the white pigments for the white reflective layer include barium sulfate, zinc oxide, barium stearate, silver flakes, silicates, alumina, zirconium oxide, sodium zirconium sulfate, kaolin, mica and titanium dioxide. In addition, non-film-forming polymer particles formed of styrene or the like may be used. They may be used alone or may be used in admixture within the range giving a reflectance to be desired.

Particularly useful white pigment is titanium dioxide.

The whiteness of the white reflective layer varies according to the kind of the pigment, the mixing ratio of the pigment and the binder and the coating weight of the pigment, however, it is desired that the light reflectance be 70% or more. In general, the whiteness increases with an increase in the coating amount of the pigment, however, when the image-forming dye diffuses through this layer, the diffusion of the dye is resisted by the pigment. It is, therefore, desired to select the appropriate coating amount of the pigment.

It is preferred that titanium dioxide be coated in an amount of from 5 to 40 g/m$^2$, preferably from 10 to 25 g/m$^2$, to obtain a white reflective layer having a light reflectance of from 78 to 85% measured with light having a wavelength of 540 nm.

Titanium dioxide can be selected from various brands commercially available.

In particular, rutile type titanium dioxide is preferably used above all.

Many of the commercially available products are surface treated with alumina, silica, zinc oxide and the like. Titanium dioxide of 5% or more of the surface treating amount is preferred for obtaining a high reflectance. Commercially available titanium dioxide includes, for example, those disclosed in *Research Disclosure*, No. 15162, as well as Ti-pure R931, the product of E. I. Du Pont de Nemours.

The binders suitable for the white reflective layer include alkali-permeable high polymer matrixes, for example, gelatin, polyvinyl alcohol, and cellulose derivatives such as hydroxyethyl cellulose and carboxymethyl cellulose.

Gelatin is particularly preferably used as the binder for the white reflective layer. The white pigment/gelatin ratio is from 1/1 to 20/1 (by weight), and preferably from 5/1 to 10/1 (by weight).

It is preferred that the discoloration inhibitors as disclosed in JP-B-62-30620 and JP-B-62-30621 are incorporated into the white reflective layer.

D) Shading Layer

The shading layer containing a shading agent and a hydrophilic binder is provided between the white reflective layer and the light-sensitive layer.

As the shading agent, any materials which have a shading function can be used, but carbon black is preferably used. Also, the decomposable dyes disclosed in U.S. Pat. No. 4,615,966 may be used.

As the binder for applying the shading agent, any materials can be used so long as it can disperse carbon black, but gelatin is preferably used.

Carbon black raw materials which can be used include those produced by any methods such as the channel method, the thermal method and the furnace method disclosed, for example, in Donnel Voet, *Carbon Black*, Marcel Dekker, Inc. (1976). There is no particular limitation on the particle size of carbon black, but the particle size is preferably from 90 to 1,800 Å. The amount of a black dye to be added as the shading agent may be adjusted according to the sensitivity of the photographic material to be shaded, and the optical density of from 5 to 10 or so is preferred.

E) Light-Sensitive Layer

In the present invention, the light-sensitive layer comprising a silver halide emulsion layer combined with a dye image-forming substance is provided on the above-described shading layer. The constitutional elements thereof are described below.

(1) Dye Image-Forming Substance

The dye image-forming substances used in the present invention are either non-diffusible compounds releasing diffusible dyes (or dye precursors) in connection with silver development or compounds whose diffusibility varies, which are described in *The Theory of the Photographic Process*, 4th Ed. These compounds are all represented by the following formula (IV):

$$(\text{DYE-Y})_n\text{—Z} \qquad \text{(IV)}$$

wherein DYE represents a dye group, a dye group temporarily shortened in wavelength, or a dye precursor group; Y represents a single bond or a connecting group; Z represents a group Which makes a difference in diffusibility of the compound represented by $(\text{DYE-Y})_n$—Z corresponding or reversely corresponding to a light-sensitive silver salt imagewise having a latent image, or a group which releases DYE to make a difference in diffusibility between the released DYE and $(\text{DYE-Y})_n$—Z; n represents 1 or 2, and when n is 2, two (DYE-Y)'s may be the same or different.

Depending on the function of Z, these compounds are broadly divided into negative type compounds which become diffusible in silver-developed portions and positive type compounds which become diffusible in undeveloped portions.

Examples of the negative type Z components include components which are oxidized as a result of development and cleaved to release diffusible dyes.

Specific example of the Z components are disclosed in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322, and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342 and JP-A-57-119345.

Of the Z components of the negative type dye-releasing redox compounds, particularly preferred groups include N-substituted sulfamoyl groups (where N-substituted groups are groups derived from aromatic hydrocarbon rings or hetero rings). Representative examples of the Z groups are shown below, but they are not limited thereto.

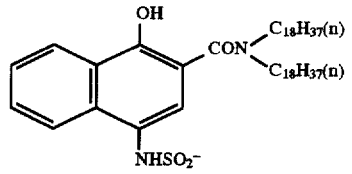

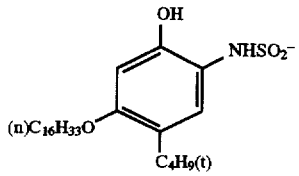

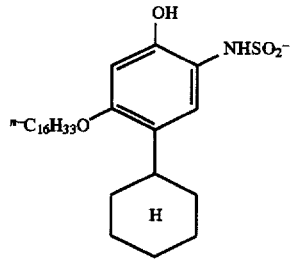

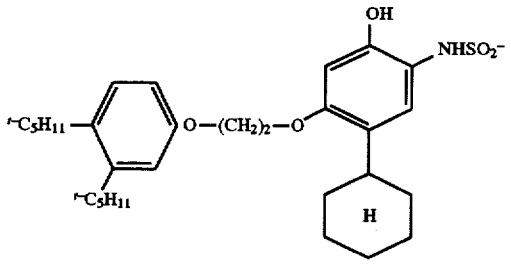

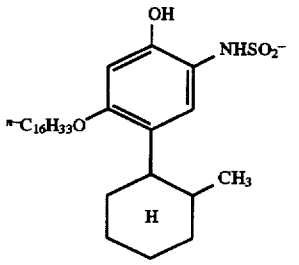

The positive type compounds are described in *Angev. Chem. Inst. Ed. Engl.*, 22, 191 (1982).

Specific examples thereof include compounds (dye developing agents) which are at first diffusible under alkaline conditions, but become non-diffusible upon oxidation by development. Typical Z components effective for the compounds of this type are disclosed in U.S. Pat. No. 2,983,606.

Further, another type of the positive type compounds include compounds which release diffusible dyes by self-cyclization, etc., under alkaline conditions, but substantially stop to release dyes upon oxidation by development. Specific examples of Z components having such a function are disclosed in U.S. Pat. No. 3,980,479, JP-A-53-69033, JP-A-54-130927, U.S. Pat. Nos. 3,421,964 and 4,199,355.

Further, other type of the positive type compounds include compounds which do not release dyes themselves, but release dyes upon reduction. The compounds of this type are used in combination with electron donors, and can release diffusible dyes imagewise by reaction with the remainder of the electron donors oxidized imagewise by silver development. Atomic groups having such a function are disclosed, for example, in U.S. Pat. Nos. 4,183,753, 4,142,891, 4,278,750, 4,139,379, 4,21,8,368, JP-A-53-110827, U.S. Pat. No. 4,278,750, 4,356,249, 4,358,525, JP-A-53-110827, JP-A-54-130927, JP-A-56-164342, Kokai Giho (JIII Journal of Technical Disclosure) 87-6199 and EP-A-220746.

Specific examples thereof are enumerated below, but the present invention should not be construed as being limited thereto.

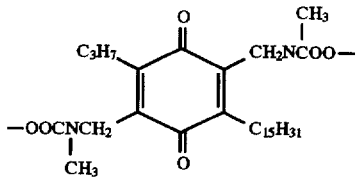

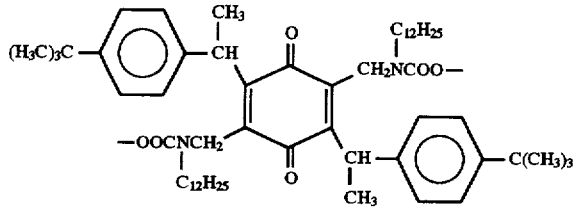

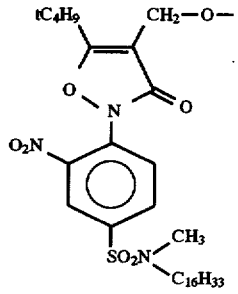

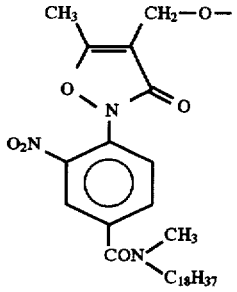

When the compounds of this type are used, they are preferably used in combination with non-diffusible electron donative compounds (well known as ED compounds) or precursors thereof. Examples of ED compounds are disclosed, for example, in U.S. Pat. Nos. 4,263,393 and 4,278,750 and JP-A-56-138736.

Further, as specific examples of dye image-forming substances of still another type the following compounds can also be used:

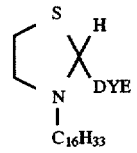

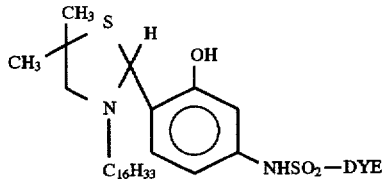

wherein DYE represents a dye or a precursor thereof having the same meaning as defined above.

Details thereof are described in U.S. Pat. Nos. 3,719,489 and 4,098,783.

On the other hand, specific examples of the dyes represented by DYE in the above formula (IV) are disclosed in the following literature:

Examples of yellow dyes.:

U.S. Pat. Nos. 3,597,200, 3,309,199, 4,013,633, 4,245,028, 4,156,609, 4,139,383, 4,195,992, 4,148,641, 4,148,643, 4,336,322, JP-A-51-114930, JP-A-56-71072, *Research Disclosure*, No. 17630 (1978) and ibid., No. 16475 (1977).

Examples of magenta dyes:

U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134.

Examples of cyan dyes:

U.S. Pat. Nos. 3,482,972, 3,482,972, 3,929,760, 4,013,635, 4,268,625, 4,171,220, 4,242,435, 4,142,891, 4,195,994, 4,147,544 and 4,148,642, British Patent 1,551,138, JP-A-54-99431, JP-A-52-8827, JP-A-53-47823, JP-A-53-143323, JP-A-54-99431, and JP-A-56-71061, European Patents (EP) 53037 and 53040, *Research Disclosure*, No. 17630 (1978) and ibid., No. 16475 (1977).

These compounds can be dispersed according to the method disclosed in JP-A-62-215272, pages 144 to 146. These dispersions may contain the compounds disclosed in JP-A-62-215272, pages 137 to 144.

(2) Silver Halide Emulsion

The silver halide emulsions for use in the present invention may be either negative type emulsions in which latent images are mainly formed on the surfaces of silver halide grains or internal latent image type direct positive emulsions in which latent images are formed inside silver halide grains.

Examples of the internal latent image type direct positive emulsions include so-called "conversion type" emulsions which are prepared utilizing the difference in solubility of silver halides and "core/shell type" emulsions in which at least the light-sensitive sites of the inner core grains of silver halides doped with metal ions and/or chemically sensitized are covered with outer shells of silver halides. These emulsions are described, for example, in U.S. Pat. Nos. 2,592,250 and 3,206,313, British Patent 1,027,146, U.S. Pat. Nos. 3,761,276, 3,935,014, 3,447,927, 2,297,875, 2,563,785, 3,551,662, 4,395,478, West German Patent 2,728,108, U.S. Pat. No. 4,431,730.

Further, when the internal latent image type direct positive emulsions are used, it is necessary to give surface fogging nuclei using light or a nucleating agent after imagewise exposure.

The nucleating agents for such a purpose include the hydrazines disclosed in U.S. Pat. Nos. 2,563,785 and 2,588,982; the hydrazines and the hydrazones disclosed in U.S. Pat. No. 3,227,552; the heterocyclic quaternary salt compounds disclosed in British Patent 1,283,835, JP-A-52-69613, U.S. Pat. Nos. 3,615,615, 3,719,494, 3,734,738, 4,094,683 and 4,115,122; the sensitizing dyes having substituents with a nucleating function in dye molecules disclosed in U.S. Pat. No. 3,718,470; the thiourea-bonding type acylhydrazine based compounds disclosed in U.S. Pat. Nos. 4,030,925, 4,031,127, 4,245,037, 4,255,511, 4,266,013 and 4,276,364 and British Patent 2,012,443; and the acylhydrazine based compounds bonded with thioamido rings or heterocyclic groups such as triazole and tetrazole as adsorptive groups disclosed in U.S. Pat. Nos. 4,080,270, 4,278,748 and British Patent 2,011,391B.

In the present invention spectral sensitizing dyes are used in combination with these negative type emulsions and internal latent image type direct positive emulsions. Specific examples thereof are disclosed in JP-A-59-180550, JP-A-60-140335, *Research Disclosure* (RD), No. 17029, U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470, and 4,025,349.

(3) Constitution of Light-Sensitive Layer

For the reproduction of natural colors by the subtractive color process, a light-sensitive layer is used which comprises at least two, in combination, of the emulsion spectrally sensitized with the above-described spectral sensitizing dye and the above-described dye image-forming substance providing a dye having selective spectral absorption within the same wavelength range. The emulsion and the dye image-forming substance may be either coated one over the other as separate layers, or may be coated as one layer by mixing them. When the dye image-forming substance has absorption in the spectral sensitivity region of the emulsion combined therewith in the coated state, it is preferred that they are coated as separate layers. Further, the emulsion layer may comprise a plurality of emulsion layers having different sensitivities, and an optional layer may be provided between the emulsion layer and the dye image-forming substance layer. For example, color image density can be raised by providing a layer containing the nucleating development accelerator disclosed in JP-A-60-173541 or the bulkhead layer disclosed in JP-B-60-15267, or the sensitivity of the light-sensitive elements can be enhanced by providing a reflective layer.

The reflective layer is a layer containing a white pigment and a hydrophilic binder. The white pigment is preferably titanium oxide and the hydrophilic binder is preferably gelatin. The coating weight of titanium oxide is from 0.1 to 8 g/m$^2$ and preferably from 0.2 to 4 g/m$^2$. Examples of the reflective layers are disclosed in JP-A-60-91354.

In a preferred multilayer structure, a combined unit of blue-sensitive emulsions, a combined unit of green-sensitive emulsions and a combined unit of red-sensitive emulsions are arranged in this order from the exposure side.

Arbitrary layers can be provided between the respective emulsion layer units, if desired. In particular, an interlayer is preferably provided in order to prevent other emulsion layer units from being adversely affected by the development effect of a certain emulsion layer.

When a developing agent is used in combination with a non-diffusible dye image-forming substance, it is preferred that the interlayer contains a non-air,usable reducing agent to prevent diffusion of the oxidation product of the developing agent. Examples of the reducing agents include non-diffusible hydroquinone, sulfonamidophenol and sulfonamidonaphthol. More specifically, they are disclosed, for example, in JP-A-50-21249, JP-A-50-23813, JP-A-49-106329, JP-A-49-129535, U.S. Pat. Nos. 2,336,327, 2,360,290, 2,403,721, 2,544,640, 2,732,300, 2,782,659, 2,937,086, 3,637,393, 3,700,453, British Patent 557,750, JP-A-57-24941, and JP-A-58-21249. Dispersing methods thereof are disclosed in JP-A-60-238831 and JP-B-60-18978.

When the compound releasing the diffusible dye with silver ions as disclosed in JP-B-55-7576 is used, it is preferred for the interlayer to contain a compound for supplementing the silver ions An irradiation-preventing layer, an ultraviolet absorbing layer, a protective layer, etc., may be provided in the present invention, according to necessity.

F) Peeling-Off Layer

In the present invention, a peeling-off layer can be provided to be peeled off in any portion of a light-sensitive sheet in a unit after processing, as required. Accordingly, this peeling-off layer must be easily peeled off after processing. Examples of materials which can be used for this purpose are disclosed in JP-A-47-8237, JP-A-59-220727, JP-A-59-229555, JP-A-49-4653, U.S. Pat. Nos. 3,220,835, 4,359,518, JP-A-49-4334, JP-A-56-65133, JP-A-45-24075, U.S. Pat. Nos. 3,227,550, 2,759,825, 4,401,746 and 4,366,227. One specific example thereof is a water-soluble (or alkaderivative such as hydroxderivative such as hydroxyethyl cellulose, cellulose acetate phthalate, plasticized methyl cellulose, ethyl cellulose, cellulose nitrate, carboxymethyl cellulose, etc. Other examples include various natural polymers such as alginic acid, pectin and gum arabic. Further, various modified gelatin such as acetylated gelatin and phthalated gelatin can also be used. Still other examples include water-soluble synthetic polymers such as polyvinyl alcohol, polyacrylate, polymethyl methacrylate, polybutyl methacrylate and copolymers thereof.

The peeling-off layer may be a single layer or may comprise a plurality of layers as disclosed in JP-A-59-220727 and JP-A-60-60642.

It is preferred that the color diffusion transfer photographic material of the present invention is allowed to have a neutralization function between a support and a light-sensitive layer, between a support and an image-receiving layer, or on a cover sheet.

II. Cover sheet

G) Support

Any support generally used in a photographic material can be used as the support of the cover sheet in the present invention as long as it is a smooth and transparent support such as cellulose acetate, polystyrene, polyethylene terephthalate or polycarbonate, and preferably provided with an undercoat layer.

The support preferably contains a trace amount of a dye to prevent light piping.

H) Layer Having Neutralization Function

The layer having a neutralization function for use in the present invention is a layer containing an acidic material in a sufficient amount to neutralize the alkali incorporated from the processing composition. The layer may have a multilayer structure comprising layers such as a neutralization speed controlling layer (i.e., a timing layer) and an adhesion-enhancing layer, if desired. Preferred examples of such acidic materials include materials containing an acidic group having a pKa of 9 or less (or a precursor group giving such an acidic group by hydrolysis). More preferably, the acidic materials include higher fatty acids such as the oleic acid disclosed in U.S. Pat. No. 2,983,606; the polymers of acrylic acid, methacrylic acid or maleic acid, partial esters thereof or acid anhydrides thereof disclosed in U.S. Pat. No. 3,362,819; the copolymers of acrylic acid and acrylates disclosed in French Patent 2,290,699; and the latex type acidic polymers disclosed in U.S. Pat. No. 4,139,383 and *Research Disclosure*, No. 16102 (1977).

In addition, the acidic materials also include those disclosed in U.S. Pat. No. 4,088,493, JP-A-52-153739, JP-A-53-1023, JP-A-53-4540, JP-A-53-4541 and JP-A-53-4542.

Specific examples of the acidic polymers include copolymers of maleic anhydride and vinyl monomers such as ethylene, vinyl acetate and vinyl methyl ether, n-butyl ester thereof, copolymers of butyl acrylate and acrylic acid, and cellulose acetate hydrogen phthalate.

The above-described acidic polymers can be used by mixture with hydrophilic polymers. Such polymers include polyacrylamide, polymethylpyrrolidone, polyvinyl alcohol (including partially saponified polyvinyl alcohol), carboxymethyl cellulose, hydroxymethyl cellulose, hydroxyethyl cellulose and polymethyl vinyl ether. Polyvinyl alcohol is preferred above all.

The above-described acidic polymers may be mixed with polymers other than the hydrophilic polymers, for example, cellulose acetate.

The coating amount of the acidic polymer is adjusted based on the amount of the alkali developed on the light-sensitive element. The equivalent ratio of the acidic polymer to the alkali per unit area is preferably from 0.9 to 2.0. If the amount of the acidic polymer is too small, the hue of a transfer dye changes or stains are generated on a white background part. If the amount is too large, troubles such as a change in hue and a decrease in light fastness arise. More preferably, the equivalent ratio thereof is from 1.0 to 1.3. Too large or too small an amount of the hydrophilic polymer to be mixed deteriorates the quality of a photograph. The weight ratio of the hydrophilic polymer to the acidic polymer is from 0.1 to 10, and preferably from 0.3 to 3.0.

Additives can be incorporated into the layer having the neutralization function according to the present invention for various purposes. For example, a hardening agent known in the art can be added to this layer to harden the layer, and a multivalent hydroxyl compound such as polyethylene glycol, polypropylene glycol or glycerol can be added to this layer to improve the brittleness of the film. In addition, an antioxidant, a brightening agent , a development inhibitor or a precursor thereof can also be added, is desired.

Useful polymers for the timing layer which is used in combination with the neutralization layer include polymers reducing alkali permeability such as gelatin, polyvinyl alcohol, partially acetalized products of polyvinyl alcohol, cellulose acetate and partially hydrolyzed polyvinyl acetate; latex polymers elevating the activation energy of alkali permeation which are produced by copolymerizing a small amount of hydrophilic comonomers such as an acrylic acid monomer; and polymers having lactone rings.

Particularly useful polymers for the timing layers include the cellulose acetate disclosed in JP-A-54-136328, U.S. Pat. Nos. 4,267,262, 4,009,030 and 4,029,849; the latex polymers produced by copolymerizing a small amount of hydrophilic comonomers such as acrylic acid disclosed in JP-A-54-128335 JP-A-56-69629, JP-A-57-6843, U.S. Pat. Nos. 4,056,394, 4,061,496, 4,199,362, 4,250,243, 4,256,827 and 4,268,604; the polymers having lactone rings disclosed in U.S. Pat. No. 4,229,516; and the polymers disclosed in JP-A- 56-25735, JP-A-56-97346, JP-A-57-6842, EP-A-31957, EP-A-37724 and EP-A-48412.

In addition, the polymers disclosed in the following literature can also be used, for example, U.S. Pat. Nos. 3,421,893, 3,455,686, 3,575,701, 3,778,265, 3,785,815, 3,847,615, 4,088,493, 4,123,275, 4,148,653, 4,201,587, 4,288,523 and 4,297,431, West German Patent Application (OLS) Nos. 1,622,936 and 2,162,277 and *Research Disclosure*, No. 15162, Vol. 151 (1976).

The timing layers using these polymers can be used as a single layer or two or more layers in combination.

Further, for example, the development inhibitors and/or precursors thereof disclosed in U.S. Pat. No. 4,009,029, West German Patent Application (OLS, Nos. 2,913,164 and 3,014,672, JP-A-54-155837 and JP-A-55-138745, the hydroquinone precursors disclosed in U.S. Pat. No. 4,201,578, and other useful photographic additives or precursors thereof can be incorporated into the timing layers formed of these polymers.

Further, it is effective for the layer having the neutralization function to be provided with an auxiliary neutralization layer for the purpose of decreasing a change in transfer density with the lapse of time after processing as disclosed in JP-A-63-168648 and JP-A-63-168649.

I) Others

In addition to the layer having the neutralization function, the cover sheet may have auxiliary layers such as a backing layer, a protective layer, and a filter dye layer.

The backing layer is provided to control curling or to impart a slipperiness. A filter dye may be added to this layer.

The protective layer is used mainly to prevent adhesion to a cover sheet back surface and adhesion to the protective layer of the photographic material when the cover sheet is superposed on the photographic material.

The cover sheet can contain a dye to adjust the sensitivity of the light-sensitive layer. A filter dye may be directly added to the support of the cover sheet, the layer having the neutralization function, the backing layer, the protective layer, or the dye capturing mordant layer, or a single layer containing the filter dye may be formed.

III. Alkali Treating Composition

The alkali treating composition for use in the present invention is uniformly developed on the light-sensitive elements after exposure there of, is provided on the back surface of the support or on their side opposite to the treating solution for the light-sensitive layer to make a pair with the shading layer, to thereby completely shield the light-sensitive layer from external light, and concurrently develops the light-sensitive layer with the components contained therein. For this purpose, the composition contains an alkali, a thickener, a shading agent and a developing agent, and further contains a development accelerator or a development inhibitor for controlling development, and an antioxidant for preventing the developing agent from deteriorating. The shading agent is necessarily contained in the composition.

The alkali is a compound which can adjust the pH of the solution to. 12 to 14. Examples is thereof include hydroxides of alkali metals (for example, isodium hydroxide, potassium hydroxide, lithiumhydroxide), phosphates of alkali metals (for example, potassium phosphate), guanidines and hydroxides of quaternary amines (for example, tetramethylammonium hydroxide). Above all, potassium hydroxide and sodium hydroxide are preferred.

The thickener is necessary to develop the treating solution uniformly and to maintain adhesion between the light-sensitive layer and the cover sheet. For example, polyvinyl alcohol, hydroxyethyl cellulose and alkaline metal salts of carboxymethyl cellulose are used, and hydroxyethyl cellulose and sodium carboxymethyl cellulose are preferably used.

As the shading agent, either a dye or a pigment or a combination thereof can be used provided it does not generate stains by diffusing to the dye image-receiving layer. Typical examples thereof include carbon black.

Any developing agent can be used as long as it cross oxidizes the dye image-forming substance and does not substantially generate stains when oxidized. Such a developing agent can be used alone or in combination of two or more, and may be used in the form of precursors. The developing agent may be contained in appropriate layers of the light-sensitive elements or in the alkali treating solution. Specific examples thereof include aminophenois and pyrazolidinones. Of these, pyrazolidinones are particularly preferred because less stain is generated.

For example, 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone and 1-p-tolyl-4-methyl-4-hydroxymethyl-3-pyrazolidinone can be enumerated.

Any of the light-sensitive sheet, the cover sheet and the alkali treating composition can contain the development accelerators disclosed on pages 72 to 91, the hardening agents disclosed on pages 146 to 155, the surface active agents disclosed on pages 201 to 210, the fluorine compounds disclosed on pages 210 to 222, the thickeners disclosed on pages 225 to 227, the antistatic agents disclosed on pages 227 to 230, the polymer latexes disclosed on pages 230 to 239, the matting agents disclosed on page 240, of JP-A-62-215272.

These alkali solution compositions are preferably transferred to the photographic materials in extended thickness (the amount of the treating solution per $m^2$ after transfer of the treating solution) of from 20 to 200 μm.

When the photographic materials containing the compound represented by formula (I) are processed, the processing temperature is preferably from 0° to 50° C. and more preferably from 0° to 40° C.

The compound of the present invention may be added to any layers of the photographic material but it is preferred to be used in combination with a green-sensitive emulsion layers.

The amount used is from 0.1 to 5 mmol, particularly preferably from 0.1 to 1 mmol, per $m^2$ of the photographic material.

Other compounds may be used in combination with the compounds of the present invention as magenta color materials.

The present invention will be described in detail with reference to the examples but the present invention is not limited thereto.

EXAMPLE 1

A transparent polyethylene terephthalate film support having a thickness of 150 μm was coated with the layers shown in Table 1 to prepare comparative Photographic Material No. 101.

TABLE 1

Constitution of Comparative Photographic Material No. 101

| Layer No. | Layer Name | Additive | Coating Amount (g/m²) |
|---|---|---|---|
| 24th Layer | Protective Layer | Gelatin | 0.26 |
| | | Additive (1) | 0.08 |
| | | Matting Agent (1) | 0.05 |
| | | Hardening Agent (1) | 0.07 |
| 23rd Layer | Ultraviolet Absorbing Layer | Gelatin | 0.48 |
| | | Ultraviolet Absorbing Agent (1) | 0.09 |
| | | Ultraviolet Absorbing Agent (2) | 0.08 |
| | | Additive (3) | 0.08 |
| 22nd Layer | Blue-Sensitive Layer (high sensitivity) | Internal Latent Image Type Direct Positive Emulsion: A (grain size corresponding to sphere: 1.4 μm, octahedral) | 0.67 (in terms of silver) |
| | | Sensitizing Dye (4) | $1.4 \times 10^{-3}$ |
| | | Sensitizing Dye (5) | $3.6 \times 10^{-4}$ |
| | | Nucleating Agent (1) | $8.9 \times 10^{-6}$ |
| | | Additive (2) | $4.1 \times 10^{-2}$ |
| | | Additive (4) | $1.1 \times 10^{-3}$ |
| | | Additive (5) | $7.0 \times 10^{-6}$ |
| | | Gelatin | 1.00 |
| 21st Layer | Blue-Sensitive Layer (middle sensitivity) | Internal Latent Image Type Direct Positive Emulsion: B | 0.11 (in terms of silver) |
| | | Sensitizing Dye (4) | $3.3 \times 10^{-4}$ |
| | | Sensitizing Dye (5) | $8.5 \times 10^{-5}$ |
| | | Nucleating Agent (1) | $2.0 \times 10^{-6}$ |
| | | Additive (2) | $9.2 \times 10^{-3}$ |
| | | Additive (4) | $2.4 \times 10^{-4}$ |
| | | Additive (5) | $1.7 \times 10^{-6}$ |
| | | Gelatin | 0.20 |
| 20th Layer | Blue-Sensitive Layer (low sensitivity) | Internal Latent Image Type Direct Positive Emulsion: C | 0.18 (in terms of silver |
| | | Sensitizing Dye (4) | $3.3 \times 10^{-4}$ |
| | | Sensitizing Dye (5) | $1.5 \times 10^{-4}$ |
| | | Nucleating Agent (1) | $7.8 \times 10^{-6}$ |
| | | Additive (2) | $2.0 \times 10^{-6}$ |
| | | Additive (4) | $2.7 \times 10^{-4}$ |
| | | Additive (5) | $2.4 \times 10^{-6}$ |
| | | Gelatin | 0.43 |
| 19th Layer | White Reflective Layer | Titanium Dioxide | 1.10 |
| | | Additive (1) | $2.5 \times 10^{-2}$ |
| | | Gelatin | 0.32 |
| 18th Layer | Yellow Color Material Layer | Yellow Dye-Releasing Compound (1) | 0.47 |
| | | High Boiling Point Organic Solvent (1) | $9.4 \times 10^{-2}$ |
| | | Accelerating Agent (1) | 0.19 |
| | | Gelatin | 0.42 |
| 17th Layer | Interlayer | Gelatin | 0.23 |
| 16th Layer | Color Mixing Preventing Layer | Additive (1) | 0.90 |
| | | Polymethyl Methacrylate | 0.25 |
| | | Gelatin | 0.51 |
| 15th Layer | Green-Sensitive Layer (high sensitivity) | Internal Latent Image Type Direct Positive Emulsion: D | 0.60 (in terms of silver) |
| | | Sensitizing Dye (2) | $1.3 \times 10^{-3}$ |
| | | Sensitizing Dye (3) | $1.1 \times 10^{-3}$ |
| | | Nucleating Agent (1) | $2.7 \times 10^{-6}$ |
| | | Additive (2) | $5.7 \times 10^{-2}$ |
| | | Additive (4) | $2.8 \times 10^{-3}$ |
| | | Additive (5) | $6.0 \times 10^{-6}$ |
| | | Gelatin | 1.14 |
| 14th Layer | Green-Sensitive Layer (middle sensitivity) | Internal Latent Image Type Direct Positive Emulsion: E | 0.09 (in terms of silver) |
| | | Sensitizing Dye (2) | $9.0 \times 10^{-5}$ |
| | | Sensitizing Dye (3) | $7.0 \times 10^{-5}$ |
| | | Nucleating Agent (1) | $1.6 \times 10^{-6}$ |
| | | Additive (2) | $1.9 \times 10^{-2}$ |

TABLE 1-continued

Constitution of Comparative Photographic Material No. 101

| Layer No. | Layer Name | Additive | Coating Amount (g/m²) |
|---|---|---|---|
| | | Additive (4) | $2.4 \times 10^{-4}$ |
| | | Gelatin | 0.19 |
| 13th Layer | Green-Sensitive Layer (low sensitivity) | Internal Latent Image Type Direct Positive Emulsion: F | 0.11 (in terms of silver) |
| | | Sensitizing Dye (2) | $7.0 \times 10^{-5}$ |
| | | Sensitizing Dye (3) | $5.0 \times 10^{-5}$ |
| | | Nucleating Agent (1) | $1.3 \times 10^{-6}$ |
| | | Additive (2) | $2.3 \times 10^{-2}$ |
| | | Additive (4) | $2.3 \times 10^{-4}$ |
| | | Gelatin | 0.18 |
| 12th Layer | White Reflective Layer | Titanium Dioxide | 1.20 |
| | | Additive (1) | $4.8 \times 10^{-2}$ |
| | | Additive (3) | $2.7 \times 10^{-2}$ |
| | | Gelatin | 0.36 |
| 11th Layer | Magenta Color Material Layer | Magenta Dye-releasing Compound (1) | 0.33 |
| | | Additive (1) | $1.6 \times 10^{-4}$ |
| | | Accelerating Agent (1) | 0.12 |
| | | Gelatin | 0.19 |
| 10th Layer | Interlayer | Gelatin | 0.29 |
| 9th Layer | Color Mixing Preventing Layer | Additive (1) | 1.70 |
| | | Polymethyl Methacrylate | 0.43 |
| | | Gelatin | 0.86 |
| 8th Layer | Red-Sensitive Layer (high sensitivity) | Internal Latent Image Type Direct Positive Emulsion: G | 0.52 (in terms of silver) |
| | | Additive (6) | $1.2 \times 10^{-4}$ |
| | | Sensitizing Dye (1) | $6.4 \times 10^{-4}$ |
| | | Nucleating Agent (1) | $3.5 \times 10^{-6}$ |
| | | Additive (2) | $3.9 \times 10^{-2}$ |
| | | Additive (4) | $2.6 \times 10^{-3}$ |
| | | Gelatin | 0.52 |
| 7th Layer | Red-Sensitive Layer (middle sensitivity) | Internal Latent Image Type Direct Positive Emulsion: H | 0.15 (in terms of silver) |
| | | Sensitizing Dye (1) | $2.3 \times 10^{-4}$ |
| | | Nucleating Agent (1) | $5.1 \times 10^{-6}$ |
| | | Additive (2) | $2.5 \times 10^{-2}$ |
| | | Additive (4) | $7.9 \times 10^{-4}$ |
| | | Gelatin | 0.62 |
| 6th Layer | Red-Sensitive Layer (low sensitivity) | Internal Latent Image Type Direct Positive Emulsion: I | 0.12 (in terms of silver) |
| | | Sensitizing Dye (1) | $2.9 \times 10^{-4}$ |
| | | Nucleating Agent (1) | $2.1 \times 10^{-5}$ |
| | | Additive (2) | $2.0 \times 10^{-2}$ |
| | | Additive (4) | $6.5 \times 10^{-4}$ |
| | | Gelatin | 0.51 |
| 5th Layer | White Reflective Layer | Titanium Dioxide | 3.40 |
| | | Gelatin | 0.84 |
| 4th Layer | Cyan Color Material Layer | Cyan Dye-releasing Compound (1) | 0.36 |
| | | High Boiling Point Organic Solvent (1) | $3.0 \times 10^{-2}$ |
| | | Additive (2) | $3.0 \times 10^{-2}$ |
| | | Accelerating Agent (1) | 0.12 |
| | | Gelatin | 0.4 |
| 3rd Layer | Opaque Layer | Carbon Black | 1.70 |
| | | Gelatin | 1.70 |
| 2nd Layer | White Reflective Layer | Titanium Dioxide | 22.00 |
| | | Gelatin | 2.75 |
| 1st Layer | Image-receiving Layer | Polymer Mordant (1) | 3.00 |
| | | Gelatin | 3.00 |
| Support (polyethylene terephthalate, 120 μm) | | | |

TABLE 2

| Characteristic Value of Emulsion | | | |
|---|---|---|---|
| Emulsion Name | Halide Composition | Core/Shell Ratio | Average*1) Grain Size (μm) |
| Emulsion A | $AgBr_{100}$ | 1/5 | 1.40 |
| Emulsion B | $AgBr_{100}$ | 1/20 | 1.10 |
| Emulsion C | $AgBr_{100}$ | 1/11 | 0.83 |
| Emulsion D*2) | $AgBr_{100}$ | 1/5 | 1.40 |
| Emulsion E | $AgBr_{100}$ | 1/20 | 1.00 |
| Emulsion F | $AgBr_{100}$ | 1/5 | 0.83 |
| Emulsion G | $AcBr_{100}$ | 1/5 | 1.40 |
| Emulsion H | $AgBr_{100}$ | 1/5 | 1.00 |
| Emulsion I | $AgBr_{100}$ | 1/10 | 0.56 |

*1) Grain size corresponding to sphere

*2) Aspect ratio = 6.34 (average grain diameter/average grain thickness)

Nucleating Agent (1)

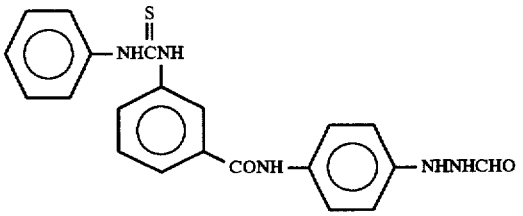

Sensitizing Dye (1)

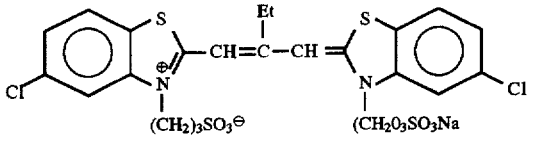

Sensitizing Dye (2)

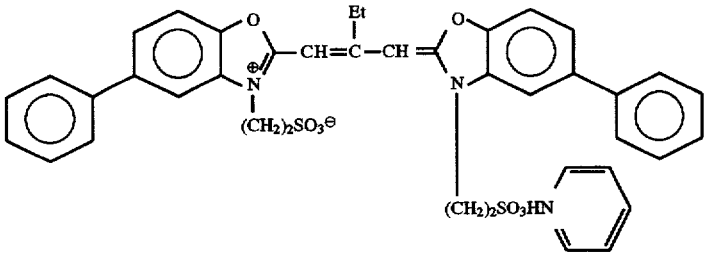

Sensitizing Dye (3)

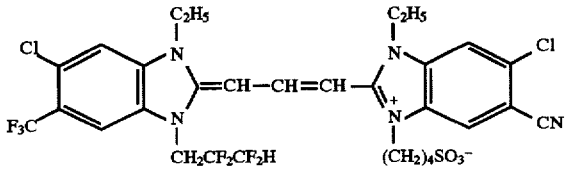

Yellow Dye-releasing Compound (1)

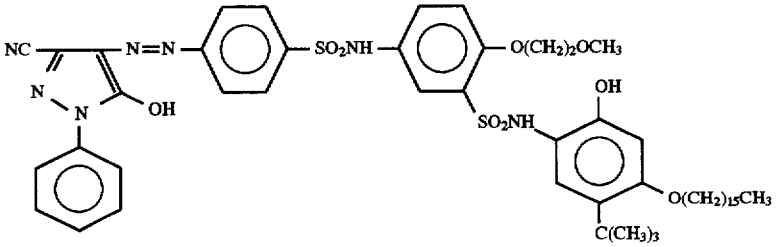

Additive (1)
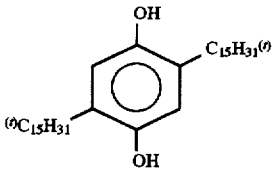
-continued
Additive (2)
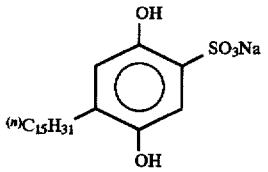
Additive (3)
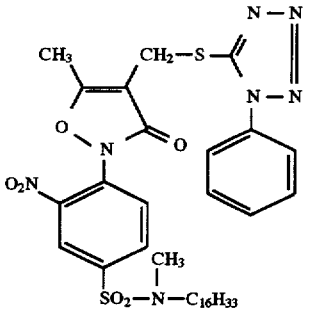
Additive (4)
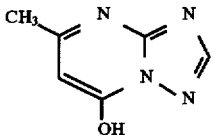
Additive (5)
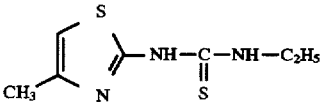
Additive (6)
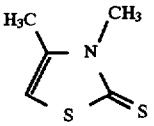
High Boiling Point Organic Solvent (1)
Tricyclohexyl Phosphate
Hardening Agent (1)
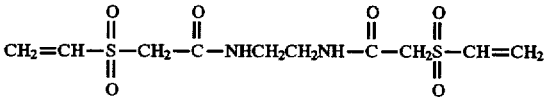
Sensitizing Dye (4)
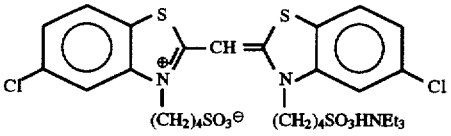
Sensitizing Dye (5)
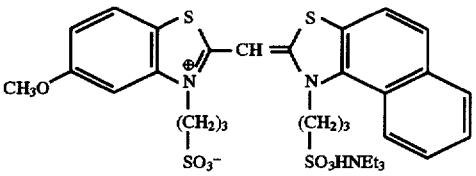
Cyan Dye-releasing Compound (1)
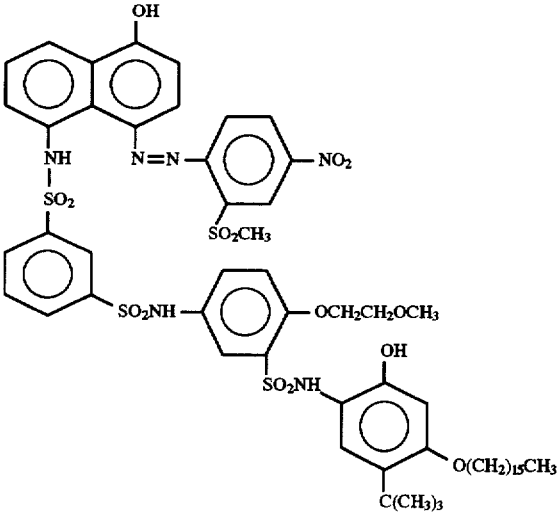
Magenta Dye-releasing Compound (1)
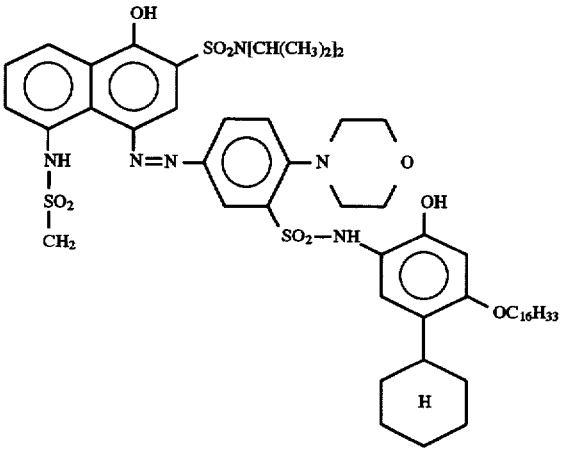

-continued

Polymer Mordant (1)

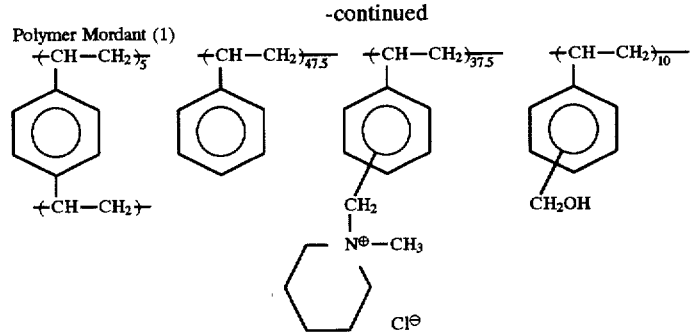

Ultraviolet Absorbing Agent (1)

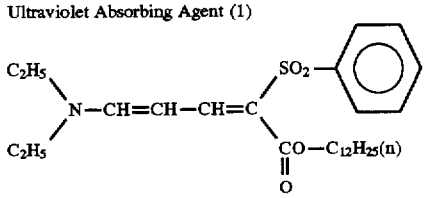

Ultraviolet Absorbing Agent (2)

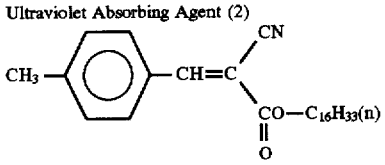

Matting Agent (1)
Polymethyl Methacrylate Spherical Latex
(average grain size: 4 μm)

Accelerating Agent (1)

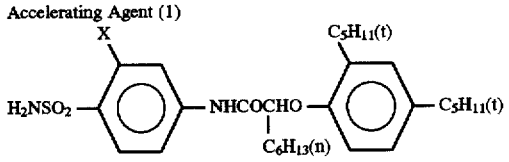

X = H, $CH_3$
mol ratio = 1/1

Photographic materials (Comparative Photographic Material No. 102 and Photographic Material Nos. 103 to 110) were prepared in the same manner as the preparation of Photographic Material No. 101 except that the magenta dye-releasing compound (magenta color or material ) in the eleventh layer (magenta color material layer) was replaced with the compound for comparison or the compound of the present invention each in an equimolar amount as shown in Table 3.

A cover sheet was prepared in the following manner.

The following layers were coated on a polyethylene terephthalate transparent support undercoated With gelatin and containing a light piping preventing dye.

(1) A neutralization layer containing 10.4 g/$m^2$ of an acrylic acid/butyl acrylate copolymer (molar ratio: 8/2) having an average molecular weight 0of 50,000 and 0.1 g/$m^2$ of 1,4-bis(2,3-epoxypropoxy)butane, (2) A neutralization timing layer containing 4.3 g/$m^2$ of acetyl cellulose having an acetylation degree of 51% and 0.2 g/$m^2$ of poly(methyl vinyl ether-co-monomethyl-maleate), and (3) A layer Containing a mixture in a solid ratio of 6/4 of a polymer latex obtained by emulsion polymerization of styrene/butyl acrylate/acrylic acid/N-methylolacrylamide in a weight ratio of 49.7/42.3/4/4 and a polymer latex obtained by emulsion polymerization of methyl methacrylate/acrylic acid/N-methylolacrylamide in a weight ratio of 93/3/4 to give a total solid content of 1.0 g/$m^2$.

The formulation of the alkali treating composition is shown below.

1 -p-Tolyl-4-hydroxymethyl-4 -methyl-3-10.0 g pyrazolidinone
Methylhydroquinone 0.18 g
5-Methylbenzotriazole 3.0 g
Sodium Sulfite (anhydrous 0.2 g
Benzyl Alcohol 1.5 ml
Carboxymethyl Cellulose Sodium Salt 58 g
Carbon Black 150 g
Potassium Hydroxide (28% ag. soln.) 200 ml water 680 ml Each "pressure-rupturable container" was filled with 0.8 g of the treating solution having the above-described composition.

After exposure from the emulsion layer side through a gray filter, the above-described photographic material was overlapped with the above-described cover sheet, and the above-described treating solution was developed between both materials to a thickness of 75 μm using a pressure roller at 25° C.

The photographic properties were evaluated by the minimun density (Dmin) and the maximum density (Dmax) in magenta reflective density after a lapse of 2 hours after processing. The samples after measurement were allowed to stand under conditions of 25° C., 55% RH for 7 days and again Dmax was measured, and the increase of the density from the first on after development (δDmax) was measured.

The measurement was carried out with a Fuji style densitometer (F.S D).

The results obtained are shown in Table 3 below.

TABLE 3

| Photographic Material | Magenta Color Material | Magenta Reflective Density Dmin | Dmax | δDmax | Remarks |
|---|---|---|---|---|---|
| 101 | R-1 | 0.16 | 1.92 | 0.31 | Comparison |
| 102 | R-2 | 0.16 | 1.59 | 0.30 | Comparison |
| 103 | (1) | 0.16 | 2.28 | 0.10 | Invention |
| 104 | (2) | 0.16 | 2.19 | 0.11 | Invention |
| 105 | (3) | 0.15 | 2.10 | 0.14 | Invention |
| 106 | (5) | 0.15 | 2.24 | 0.12 | Invention |
| 107 | (6) | 0.16 | 2.28 | 0.11 | Invention |
| 108 | (8) | 0.16 | 2.00 | 0.12 | Invention |
| 109 | (11) | 0.16 | 2.02 | 0.11 | Invention |
| 110 | (12) | 0.16 | 2.10 | 0.10 | Invention |

* R-1: Compound (25) disclosed in JP-A-60-79353
R-2: Compound (9) disclosed in JP-A-59-114540

As is apparent from the results in Table 3, when the compounds of the present invention are used, high transfer density can be obtained and yet the change in density from the first on after development is largely suppressed.

EXAMPLE 2

Photographic Material No. 201 for comparison having the following constitution was prepared.

Light-sensitive Element 201

A transparent polyethylene terephthalate support was coated with the following each layer to prepare a light-sensitive sheet Backing Layer:

(a) a shading layer containing 4.0 g/m$^2$ of carbon black and 2.0 g/m$^2$ of gelatin, Emulsion Layer Side:

(1) a layer containing 0.44 g/m$^2$ of the following cyan dye-releasing redox compound, 0.09 g/m$^2$ of tricyclohexyl phosphate, 0.008 g/m$^2$ of 2,5-di-t-pentadecylhydroquinone and 0.8 g/m$^2$ of gelatin, (2) a layer containing 0.5 g/m$^2$ of gelatin, (3) a red-sensitive emulsion layer containing 0.6 g/m$^2$ in terms of silver of a red-sensitive internal latent image type direct positive silver bromide emulsion, 1.2 g/m$^2$ of gelatin, 0. 015 g/m$^2$ of the following nucleating agent and 0.06 g/m$^2$ of 2-sulfo-5-n-pentadecylhydroquinone sodium salt,

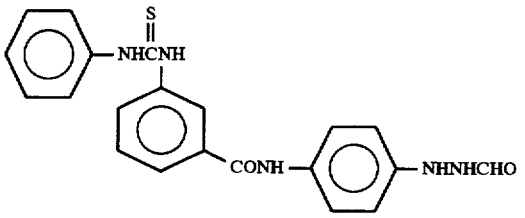

(4) a layer containing 0.43 g/m$^2$ of 2,5-di-t-pentadecylhydroquinone, 0.1 g/m$^2$ of trihexyl phosphate and 0.4 g/m$^2$ of gelatin, (5) a layer containing 0.3 mmol/m$^2$ of Magenta Color Material R-2 (dye-releasing redox compound) shown in Table 5, 0.08 g/m$^2$ of tricyclohexyl phosphate, 0.009 g/m$^2$ of 2,5-di-t-pentadecylhydroquinone and 0.5 g/m$^2$ of gelatin, (6) a green-sensitive emulsion layer containing 0.42 g/m$^2$ in terms of silver if a green-sensitive internal latent image type direct positive silver bromide emulsion, 0.9 g/m$^2$ of gelatin, 0.013 mg/m$^2$ of the same nucleating agent as in layer (3) and 0.07 g/m$^2$ of 2-sulfo-5-n-pentadecylhydroquinone sodium salt, (7) a layer the same as (4), (8) a layer containing 0.53 g/m$^2$ of the following yellow dye-releasing redox compound, 0.13 g/m$^2$ of tricyclohexyl phosphate, 0.014 g/m$^2$ of 2,5-di-t-pentadecylhydroquinone and 0.7 g/m$^2$ of gelatin,

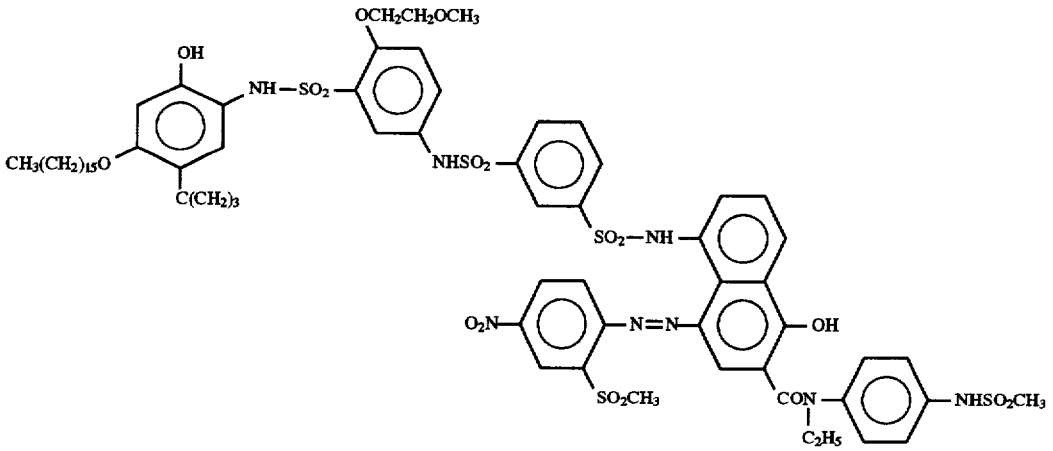

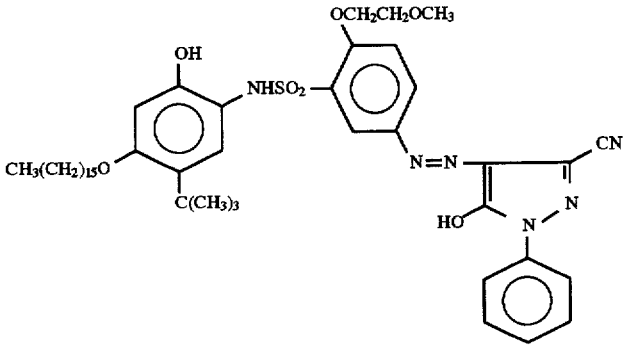

(9) a blue-sensitive emulsion layer containing 0.6 g/m$^2$ in terms of silver of a blue-sensitive internal latent image type direct positive silver bromide emulsion 1.1 g/m$^2$ of gelatin, 0.019 mg/m$^2$ of the same nucleating agent as in layer (3) and 0.05 g/m$^2$ of 2-sulfo-5-n-pentadecylhydroquinone sodium salt, and

(10) a layer containing 1.0 g/m$^2$ of gelatin.

Then, photographic materials (Photographic Material Nos. 202 to 207) were prepared in the same manner as the preparation of Photographic Material No. 201 except that the compounds of the present invention shown in Table 5 below were added to the layers containing the magenta dye-releasing redox compounds each in an amount of 100 mol %.

Dye Image-receiving Sheet

An image-receiving sheet (dye-fixing element) having the layer constitution as shown in Table 4 was prepared.

TABLE 4

Dye-fixing Element

| Layer No. | Layer Name | Additive | Coating Amount (g/m$^2$) |
|---|---|---|---|
| 10th Layer | Protective Layer | Gelatin | 0.60 |
| 9th Layer | Mordant Layer | Gelatin | 3.00 |
| | | Mordant (B) | 0.50 |
| | | Coating Aid (A) | 3.00 |
| 8th Layer | Timing Layer (1) | Polymer Latex (1) | 0.96 |
| | | Polymer Latex (2) | 0.64 |
| 7th Layer | Interlayer | Poly-2-hydroxyethyl Methacrylate | 0.46 |
| 6th Layer | Timing Layer (2) | Cellulose Acetate (acetylation degree: 51.3%) | 4.27 |
| | | Styrene/Maleic Anhydride Copolymer (molar ratio: 1/1) (average molecular weight: 10,000), Internal Latent Image Type Direct Positive Emulsion | 0.23 |
| 5th Layer | Neutralization Layer | Acrylic Acid/Butyl Acrylate (average molecular weight: 10,000) (molar ratio: 8/2) | 22.0 |
| Paper Support (150 μm, laminated with 30 μm-thick polyethylene on both sides) | | | |
| 4th Layer | Shading Layer | Gelatin | 2.0 |
| | | Carbon Black | 4.0 |
| 3rd Layer | White Reflective Layer | Titanium Dioxide | 8.00 |
| | | Gelatin | 1.00 |

TABLE 4-continued

Dye-fixing Element

| Layer No. | Layer Name | Additive | Coating Amount (g/m$^2$) |
|---|---|---|---|
| 1st Layer | Protective Layer | Gelatin | 0.60 |
| Polymer Latex (1): | | styrene/butyl acrylate/acrylic acid/N-methylol acrylamide (49.7/42.3/4/4 by weight) | |
| Polymer Latex (2): | | styrene/butyl acrylate/acrylic acid/N-methylol acrylamide (93/3/4 by weight) | |

(Compound 25)

R-1

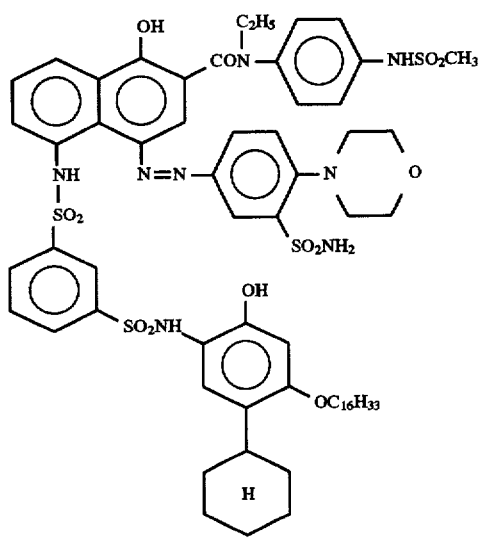

-continued (Compound 25)

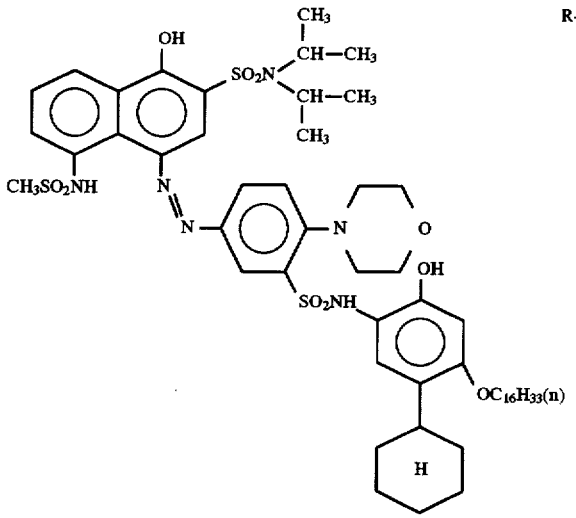

Treating Solution 1-p-Tolyl-4-hydroxymethyl-4-methyl-3-pyrazolidinone 6.9 g

Methylhydroquinone 0.3 g

5-Methylbenzotriazole 3.5 g

Sodium Sulfite (anhydrous) 0.2 g

Carboxymethyl Cellulose Sodium Salt 58 g

Potassium Hydroxide (28% aq. soln.) 200 ml

Benzyl Alcohol 1.5 ml

Water 835 ml

Then, after the light-sensitive sheet (light-sensitive element) was imagewise exposed, the light-sensitive sheet was superposed on the image-receiving sheet and the above-described treating solution was developed between both sheets to a thickness of 60 μm.

Processing was carried out at 25° C. and the maximum density (Dmax) when the light-sensitive sheet was peeled off from the image-receiving sheet 90 seconds after processing and Dmax when peeled off 180 seconds after processing were examined.

The results obtained are shown in Table 5 below.

TABLE 5

| Photographic Material | Magenta Color Material | Magenta Reflective Density (Dmax) Peeling-off Time 60 sec. | 180 sec. | Remarks |
|---|---|---|---|---|
| 201 | R-2 | 1.71 | 2.08 | Comparison |
| 202 | (1) | 2.06 | 2.18 | Invention |
| 203 | (2) | 2.00 | 2.12 | Invention |

TABLE 5-continued

| Photographic Material | Magenta Color Material | Magenta Reflective Density (Dmax) Peeling-off Time 60 sec. | 180 sec. | Remarks |
|---|---|---|---|---|
| 204 | (4) | 1.99 | 2.13 | Invention |
| 205 | (8) | 2.01 | 2.14 | Invention |
| 206 | (11) | 2.03 | 2.15 | Invention |
| 207 | (12) | 2.11 | 2.25 | Invention |

* R-2: Compound (9) disclosed in JP-A-59-114540.

As is apparent from the results in Table 5, when the compounds of the present invention are used, not only the transfer density increases, but also the peeling-off time dependency of Dmax is improved.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic material which comprises at least one silver halide emulsion layer and at least one compound represented by the following formula (I):

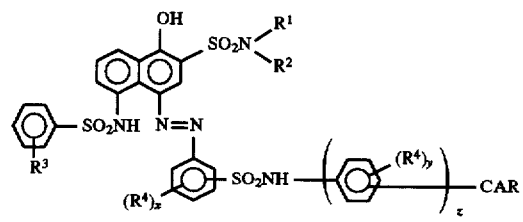

(I)

wherein $R^1$ and $R^2$ each independently represents an alkyl group having 1 to 6 carbon atoms, a phenyl group, a 1-naphthyl group or a 2-naphthyl group, and $R^1$ and $R^2$ may be linked to form a 5- or 6-membered ring directly or via an oxygen atom or a nitrogen atom; $R^3$ represents an $—NHSO_2R_{10}$ group, an $—SO_2NHCOR_{10}$ group, an $—SO_2NHSO_2R_{10}$ group or an $—NHCOR_{10}$ group; $R^{10}$ represents an alkyl group; $R^4$ an $R^5$ each represents a halogen atom, an amino group, a cyano group, a nitro group, an alkyl group, an alkoxyl group, an alkylsulfonyl group, a sulfamoyl group, a carbamoyl group or an alkoxycarbonyl group, and when there are a plurality of $R^4$ and $R^5$, they may be the same or different; CAR represents a group which releases a dye different from the compound represented by formula (I) in diffusibility by oxidation; x and y each represents 0, 1 or 2; and z represents 0 or 1.

* * * * *